US009255499B2

(12) United States Patent
Howarth et al.

(10) Patent No.: US 9,255,499 B2
(45) Date of Patent: Feb. 9, 2016

(54) ROTOR FOR VARIABLE VALVE TIMING SYSTEM AND VVT SYSTEM COMPRISING THE ROTOR

(71) Applicant: DSM IP Assets B.V., Heerlen (NL)

(72) Inventors: Carl Howarth, Camp Hill, PA (US); Jeff Harding, Evansville, IL (US); Bill Burnham, Evansville, IL (US)

(73) Assignee: DSM IP ASSETS B.V., Heerlen (NL)

( * ) Notice: Subject to any disclaimer, the term of this patent is extended or adjusted under 35 U.S.C. 154(b) by 0 days.

(21) Appl. No.: 14/397,272

(22) PCT Filed: Apr. 26, 2013

(86) PCT No.: PCT/EP2013/058760
§ 371 (c)(1),
(2) Date: Oct. 27, 2014

(87) PCT Pub. No.: WO2013/164272
PCT Pub. Date: Nov. 7, 2013

(65) Prior Publication Data

US 2015/0075465 A1 Mar. 19, 2015

Related U.S. Application Data

(60) Provisional application No. 61/640,866, filed on May 1, 2012.

(30) Foreign Application Priority Data

Jun. 13, 2012 (EP) ..... 12171715

(51) Int. Cl.
*F01L 1/34* (2006.01)
*F01L 1/344* (2006.01)

(52) U.S. Cl.
CPC ..... *F01L 1/34* (2013.01); *F01L 1/3442* (2013.01); *F01L 2001/34479* (2013.01); *F01L 2101/00* (2013.01)

(58) Field of Classification Search
CPC . F01L 1/34; F01L 1/3442; F01L 2001/34479; F01L 2101/00
USPC ..... 123/90.15, 90.17
See application file for complete search history.

(56) References Cited

U.S. PATENT DOCUMENTS 6,186,103 B1 2/2001 Schafer et al.
7,640,902 B2 * 1/2010 Knecht ..... F01L 1/3442 123/90.15

(Continued)

OTHER PUBLICATIONS

International Search Report for PCT/EP2013/058760 mailed Jun. 13, 2013.

*Primary Examiner* — Ching Chang
(74) *Attorney, Agent, or Firm* — Nixon & Vanderhye P.C.

(57) ABSTRACT

The invention relates to rotor body for a variable valve timing system, comprising a main body comprising a front side, a back side and vanes tips, made from a fibrous reinforced polymeric material, a central part comprising an (axial) bore hole made of metal, and sealing elements made of a non-reinforced polymeric material at the vain tips and at the front side and back side. The invention also relates to a variable valve timing system comprising an assembly of a rotor and a stator receiving the rotor on a camshaft, wherein the rotor is a rotor body as described above, wherein an end part of the camshaft and/or a fixing element is received in the bore hole and the rotor is fixed at the end part of the camshaft with the fixing element.

11 Claims, 4 Drawing Sheets

(56) References Cited

U.S. PATENT DOCUMENTS

Figure 1A:
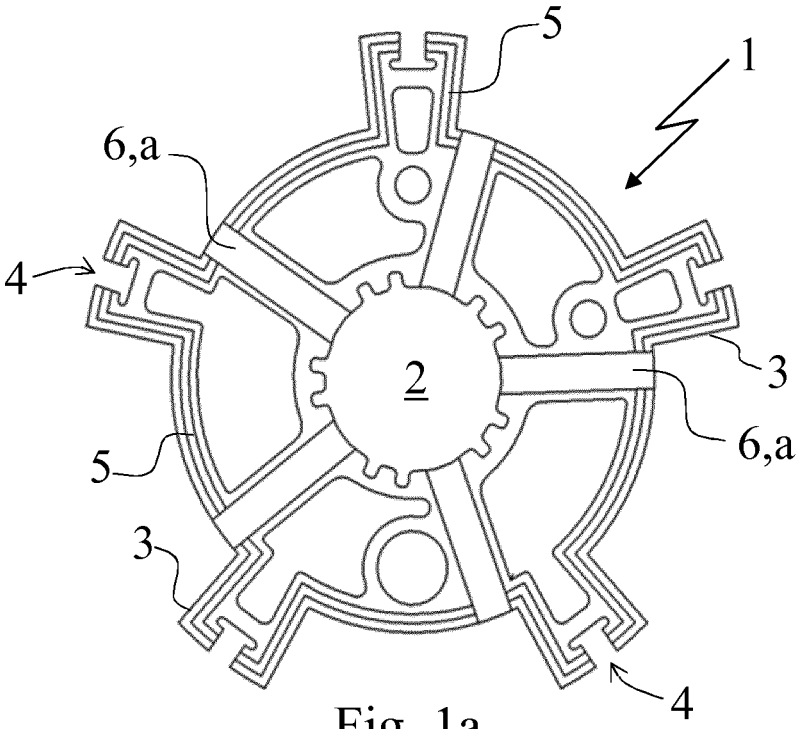

2006/0278189 A1 12/2006 Knecht et al.
2008/0146402 A1 6/2008 Shinohara
2009/0090321 A1 4/2009 Kleiber et al.

* cited by examiner

ROTOR FOR VARIABLE VALVE TIMING SYSTEM AND VVT SYSTEM COMPRISING THE ROTOR

This application is the U.S. national phase of International Application No. PCT/EP2013/058760 filed 26 Apr. 2013 which designated the U.S. and claims priority to U.S. Provsional Application No. 61/640,866 filed 1 May 2012, and European Patent Application No. 12171715.1 filed 13 Jun. 2012, the entire contents of each of which are hereby incorporated by reference.

The invention relates to variable valve timing (VVT) system comprising an assembly of a rotor and a stator receiving the rotor on a camshaft, as well as to the rotor for use in the VVT system.

In internal combustion engines, variable valve timing (VVT), also known as variable valve timed phaser or variable valve actuation (VVA), is a generalized term used to describe any mechanism or method that can alter the shape or timing of a valve lift event within an internal combustion engine. VVT allows the lift, duration or timing (in various combinations) of the intake and/or exhaust valves to be changed while the engine is in operation. Two-stroke engines use a power valve system to get similar results to VVT. There are many ways in which this can be achieved, ranging from mechanical devices to electro-hydraulic and camless systems. In this case we focus on camshaft based VVT systems, and more particular for use in the automotive industry.

The elements in a VVT system, the rotor, also called internal rotor or driven element, and the stator, also called drive wheel, are typically of complex shape. The rotor body typically comprises a main body with vanes, channels for oil or air transport, and a central bore hole for assembly to the camshaft. The stator can consist of multiple parts, such as a stator housing, and cover for the front side and the back side. The stator housing may be a separate part, as it typically has a complex shape or an integral with either the front cover or the back cover. The main body of the rotor comprises a front side for engaging with a front side cover and a back side for engaging with a back side cover. The vanes in combination with the stator housing define variable oil or air pressure chambers inside a stator housing and having vane tips for engaging with the stator housing. The channels allow for the oil or air transport from one pressure chamber to other pressure chambers.

Up to now the rotor and stator parts used in the automotive industry are made from metal. Production and processing of such parts is very costly, in particular in view of the complex shape of the parts and the extremely high demands on dimensional accuracy in view of oil leakage. Moreover, in the automotive industry there is a lot of attention for weight reduction. Therefore there is an interest in changing the metal parts into plastic parts. However, the use of plastic parts in this application creates a lot of problems. For the assembly on the camshaft and the oil sealing function, high mechanical loads are needed. Due to differences in thermal expansions of plastic materials, certainly in combination with metal, dimensional fit is suffering which results in oil leakage during practical use and insufficient pressure transfer inside the VVT system. Furthermore, high torques have to be transferred from the VVT system to the cam shaft, which involves high mechanical loads and forces. Polymeric materials are generally less good in bearing mechanical loads.

The aim of the invention is to provide a rotor body for a VVT system, wherein these problems are overcome, at least in part.

This aim has been achieved with the rotor body according to the invention, wherein the rotor body comprises:

- a main body comprised of a fibrous reinforced polymeric material;
- a central part comprising an (axial) bore hole running from the front side to the back side of the rotor body for receiving a camshaft, or a bolt for fixing to the camshaft, the central part being made of metal;
- dynamic sealing elements (i) at the vane tips for engaging with a stator housing; and
- dynamic sealing elements (ii) at the front side and the back side for engaging with a front side cover and a back side cover,
- wherein the dynamic sealing elements (i) and (ii) are made of a non-reinforced plastic material,
- and wherein the metallic central part comprises protrusions protruding into the fibrous reinforced polymeric material and/or holes filled with the fibrous reinforced material.

The effect of the rotor body according to the invention is not only that the rotor body can be more easily produced, is lighter in weight compared to a rotor body made from metal, and creates a seal between the rotor body and the stator assembly, but also that dimensional accuracy is less critical, the rotor body can be firmly affixed when being assembled on a camshaft and it retains good sealing properties over a wide range of temperatures without suffering from high mechanical loads for fixing and dimensional changes due to temperature changes. As a result of the reduced mechanical loads on the plastic body, there is less friction and wear between the rotor and stator. The resulting minimized oil leakage between the stator and rotor during operation, enables a continuous sealed oil circuit so that the system can transport oil and operate effectively. A further advantage is that the transfer of load from the rotor into the camshaft is more efficiently, but also that the efficiency of load transfer and accuracy of the timing of the load transfer are retained much longer during the function life time of the rotor in a VVT system.

The central part with the bore hole is critical to the function of the plastic rotor body as well as torque transfer into the camshaft as it functions as a compression limiter and as a first transfer element between rotor and camshaft. It contributes to the fixing and alignment of the rotor on the camshaft in a very reliable way, bearing the high load for fixing without deformation or creep of the plastic main body and meanwhile allowing for required sealing function over the whole temperature range. The central part must be able to withstand the preload from the fixing element used for the assembly on the camshaft. The fixing element may be a bolt. Suitably, the central part is designed as to be able to withstand or bear a bolt preload, or similar alternative, of at least 50 Kn. This may be achieved, for example by increasing the dimensions of the central part in radial direction relative to the central axis of the bore hole.

The shape of the metallic central part may vary, for example a have cylindrically shaped body with a cylindrical outer surface and a cylindrical bore hole. The bore hole may also have other shapes, which should preferably be in conjunction with the shape of the end of the camshaft to be received. If the bore hole has to receive the bolt, the shape is preferably cylindrical. The metallic central part suitably comprises a more or less cylindrically shaped body with a more or less cylindrical outer surface, or even a cylindrically shaped body with a cylindrical outer surface.

In a particular embodiment, metallic central part suitably comprises a shaped body with an outer surface and protrusions on the outer surface protruding into the main body made of the fibrous reinforced polymeric material. This embodiment has not only the advantage that the transfer of load from the rotor into the camshaft is more efficiently, but also that the efficiency of load transfer and accuracy of the timing of the load transfer are retained much longer during the function life time of the rotor in a VVT system.

Alternatively, the metallic central part suitably comprises holes in the shaped body at the outer surface. These holes get filled with the fibrous reinforced material when overmoulded with said material, thereby also increasing the effectiveness and efficiency of load transfer from the rotor into the camshaft, and the accuracy of the timing of the load transfer is retained much longer during the function life time of the rotor in a VVT system. The protrusions and holes may have any suitable shape, such as curls, slots, as long as these ensure a more positive attachment of the central part into the plastic rotor body.

Suitably, the central part has a central axis running from the front side to the back side of the rotor and the protrusions are extending over the surface about parallel to the central axis of the central part. Suitably, the protrusions have a finger like cross-sectional shape, the cross section being perpendicular to the central axis.

The number of protrusions may vary, for example, 2, 5, 10, 15, 20 or 25, and any integer in between or above. In a preferred embodiment, the central part has at least 4 protrusions, more preferred at least 8. The advantage of a higher number of protrusions is that the rotor can bear a higher torque load.

In a preferred embodiment of the invention, the plastic body and metallic central part are fixed to each other by interlocking elements. Suitably the protrusions on the metallic central part have a shape with interlocking capabilities, such as protrusions with holes in it, or protrusions in the form of ribs with undercuts. The advantage of the plastic body and metallic central part being fixed to each other by interlocking elements is that not only the angular displacement of the plastic body relative to the camshaft is limited, but also the radial displacement upon exertion of centrifugal forces due to radial movements is reduced.

The central part is suitably made from machined metal, cast metal or sintered metal.

The central part can be installed into the rotor body according to invention with any suitable method, such as via press fit, or by compression moulding or injection moulding of the polymeric material around the central part. Preferably, in particular in the case that the central part has holes or protrusions with interlocking capability on the outer surface, the central part is installed into the rotor body by injection moulding of the polymeric material around the central part.

The fibrous reinforced polymeric composition comprised by the main body can be any fibrous reinforced polymeric composition with good mechanical properties and a high modulus over a wide temperature range. Suitably, the main body is comprised of an injection mouldable fibrous reinforced thermoplastic or thermosetting polymeric material.

The injection mouldable fibrous reinforced thermoplastic polymeric material comprises, next to a fibrous reinforcing component, a thermoplastic polymer.

The injection mouldable fibrous reinforced thermosetting polymeric material comprises, next to a fibrous reinforcing component, a thermosetting polymer.

Suitably the fibrous reinforcing component is, for example, glass fibres or carbon.

As thermoplastic polymer can be used, for example, thermoplastic polyamides or thermoplastic polyesters, preferably thermoplastic polyamides.

An example of a suitable thermosetting polymer is a thermosetting unsaturated polymer.

Depending on the size shape and application of the VVT system, it might very well occur that the plastic rotor has to be able to withstand very high torque loadings. For example it may occur that a torque loading, or "vane pressure", of the 100 N-mm is applied to each vane element. Certain polymers such as Stanyl TW241F12 from DSM Engineering Plastics B.V. The Netherlands, can withstand this amount of torque safely.

The sealing elements on the vain tips (i) and on the front side and the back side (ii) in the rotor body according to the inventions, and the sealing elements (iii) described further below, can be made from any non-fibrous reinforced polymeric material that is suitable for dynamic sealing purposes. Suitably materials include non-fibrous reinforced thermoplastic polymeric or rubber material. Preferably, this dynamic sealing material has a good oil and temperature resistance, such as polyamide based materials, PTFE based materials, PTFE modified polymeric materials. An example of a suitable polyamide based material is Stanyl TW341, from DSM Engineering Plastics B.V. The Netherlands. In a particular embodiment the material used is a PTFE modified polyamide based materials.

For the positioning the sealing elements and better retaining the sealing properties, the sealing elements (i) are advantageously comprised by pockets at the vane tips. Analogously, the sealing elements (ii) are advantageously comprised by grooves at the front and the back side, respectively. The grooves may have any shape suitable for receiving the sealing elements (ii).

The rotor body comprises channels for the oil or air transport from one oil chamber to other oil chambers. Such channels can be created by secondary machining operations such as hole drilling, boring and facing, which due to the plastic is much easier than for metal parts. Alternatively, the channels are produced during the injection moulding process, using mold cavities with sliding elements.

In a preferred embodiment the channels are constituted by channels in the main body located at the surface at the front side and the back side of the main body, wherein the channels are covered with dynamic sealing elements (iii). These channels, since being located at the surface, are open not only in the flow direction but also at the side of the surface. By covering with the dynamic sealing elements (iii), the open part at the side of the surface is closed off, thus allowing oil or air transport only in the aimed flow direction. The dynamic sealing elements can be actuated via normal engine oil pressure or through the use of metal or plastic springs or through a combination of all. The channels can have any shape, such as that of a groove or slot, or otherwise, and may have, for example a triangular, a quadrangular, or a semi-circular or semi-ellipsoidal cross-section.

The plastic VVT rotor according to the invention with the dynamic oil sealing elements have the advantage of enabling the oil circuit channels to be moulded into the front and back surfaces of the rotor body thus eliminating all secondary machining operations such as hole drilling, boring and facing. This not only greatly reduces the manufacturing cost, but also results in better mechanical properties compared to comparable rotors.

In a particular embodiment of the rotor body according to the invention, a. the central metal parts comprises a cylindrically shaped body with a cylindrical outer surface and protrusions on the outer surface protruding into the main body made of the fibrous reinforced polymeric material; and b. the channels for the oil or air transport are constituted by channels in the main body located at the surface at the front side and the back side of the main body, wherein the channels are covered with dynamic sealing elements (iii).

The advantage is that the rotor body can bear even higher torque loadings.

The invention also relates to variable valve timing (VVT) system. The VVT system according to the invention comprises an assembly of a rotor and a stator receiving the rotor on a camshaft, wherein the rotor is a rotor body according to the invention, or any particular or preferred embodiment thereof as described above, or any combination thereof, comprising at least a main body comprising a front side, a back side and vanes tips, made from a fibrous reinforced polymeric material, a central part comprising an (axial) bore hole made of metal, and sealing elements made of a non-reinforced polymeric material at the vain tips and at the front side and back side, wherein an end part of the camshaft and/or a fixing element is received in the bore hole and the rotor is fixed at the end part of the camshaft with the fixing element. The fixing element suitably is a bolt, or alike, whereas the fixing preload may well be at least 50 Kn.

The advantages of the VVT system are as described above for the rotor body according to the invention, respectively any particular or preferred embodiment thereof, as described above.

The invention is further illustrated with the following figures.

Figure 1B:
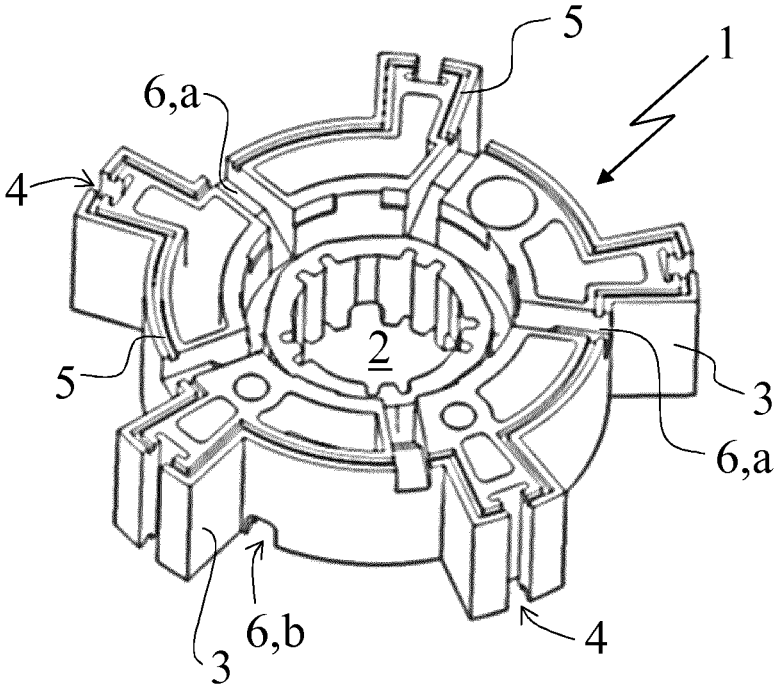

FIG. 1. Schematic front side view (a) and schematic 3-dimensional view (b) of a main body of a rotor body for a variable valve timing system according to the present invention.

Figure 2A:
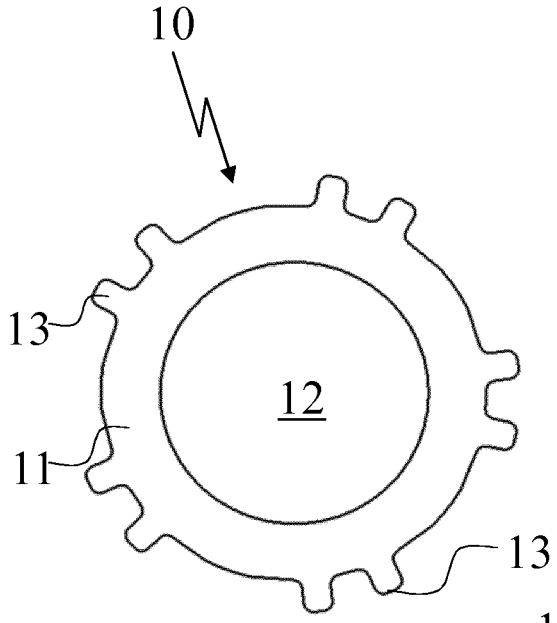
Figure 2B:
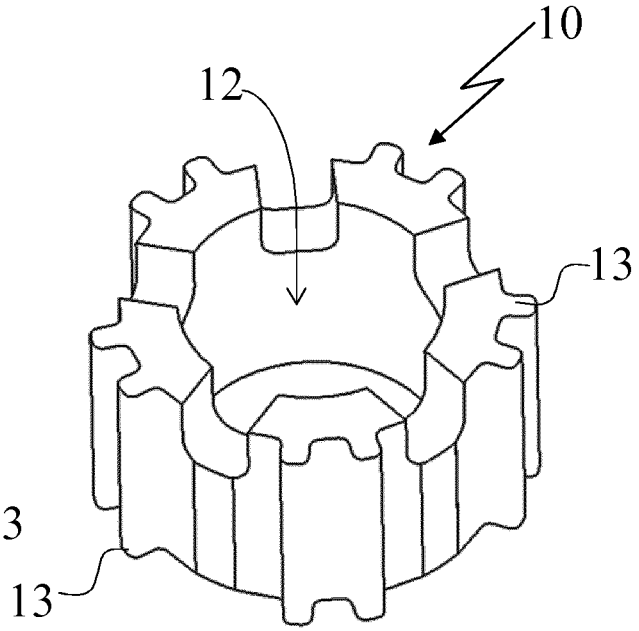

FIG. 2. Schematic top side view (a) and schematic 3-dimensional view (b) of a central part of a rotor body for a variable valve timing system according to the present invention.

Figure 3:
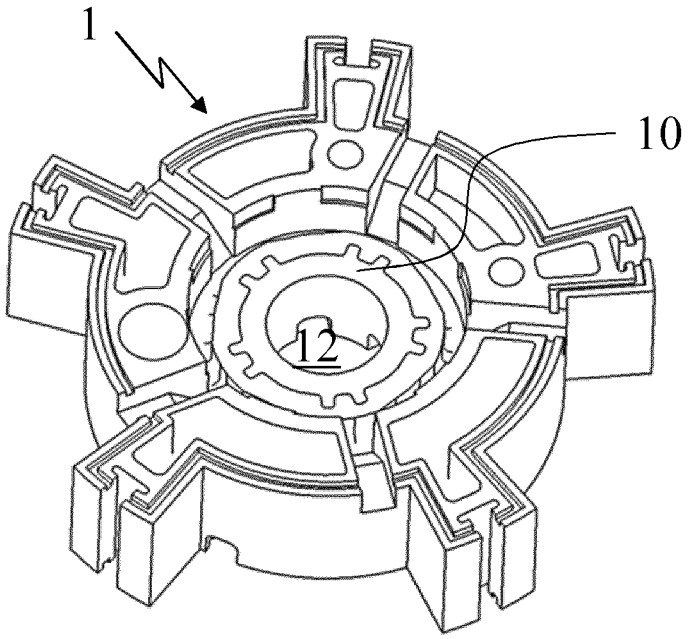
Figure 4:
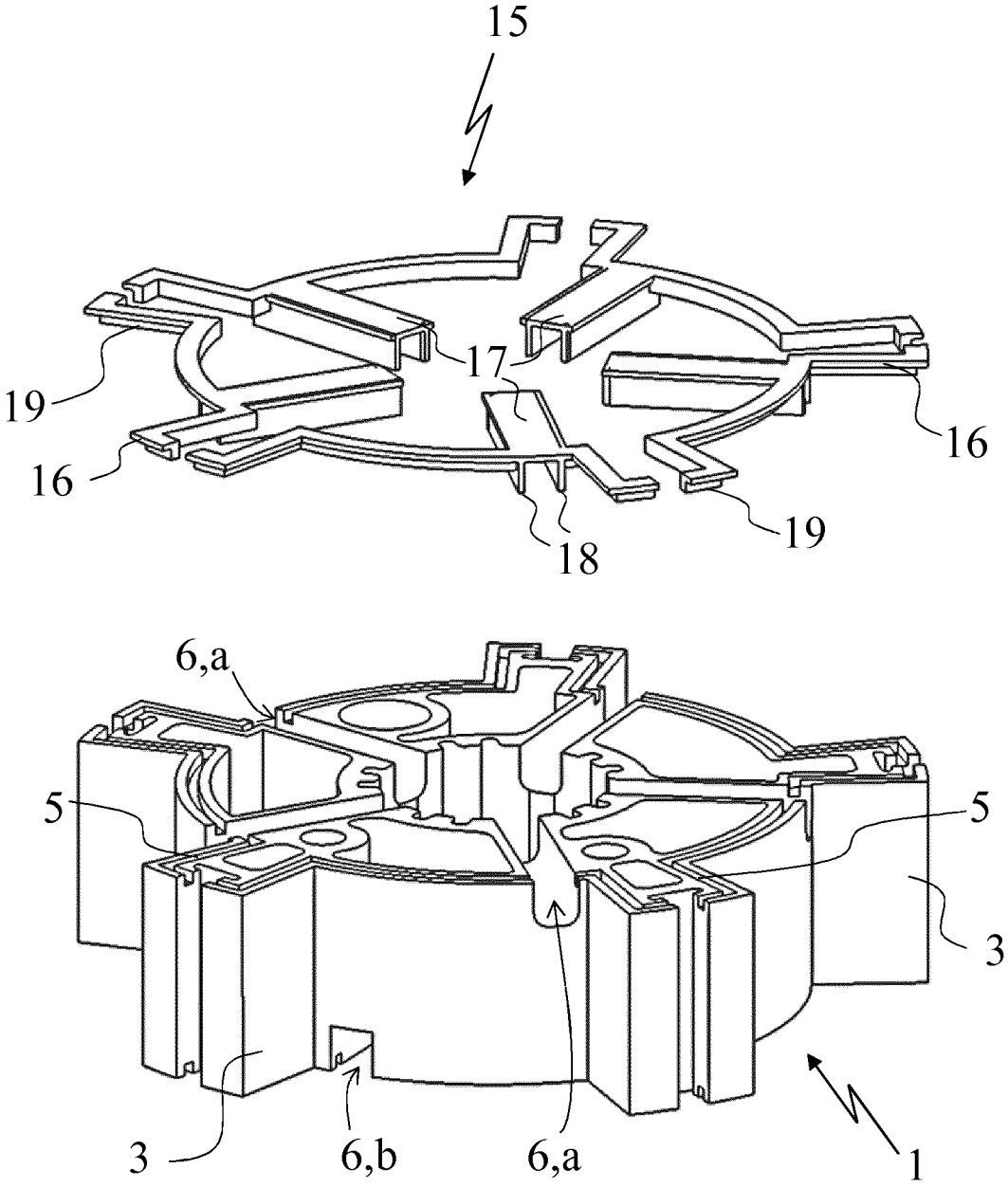

FIG. 3. Schematic 3-dimensional view of a main body and assembled therein a central part of a rotor body for a variable valve timing system according to the present invention.

dynamic sealing elements (ii) at the front side and the back side for engaging with the front side cover and the back side cover FIG. 4. Schematic 3-dimensional view of a main body and dynamic sealing element of a rotor body for a variable valve timing system according to the present invention.

Figure 5A:
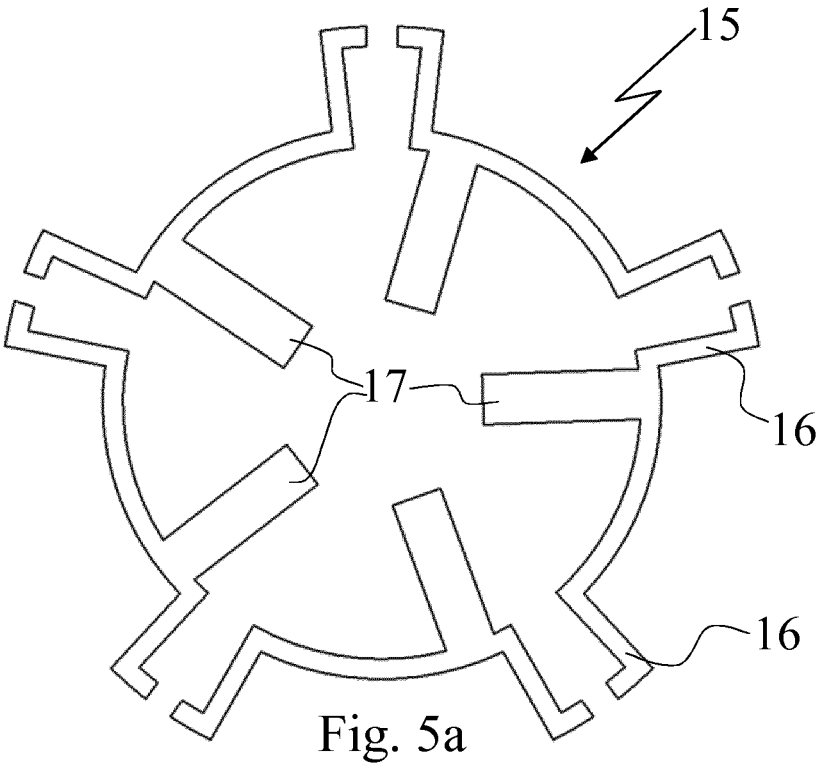
Figure 5B:
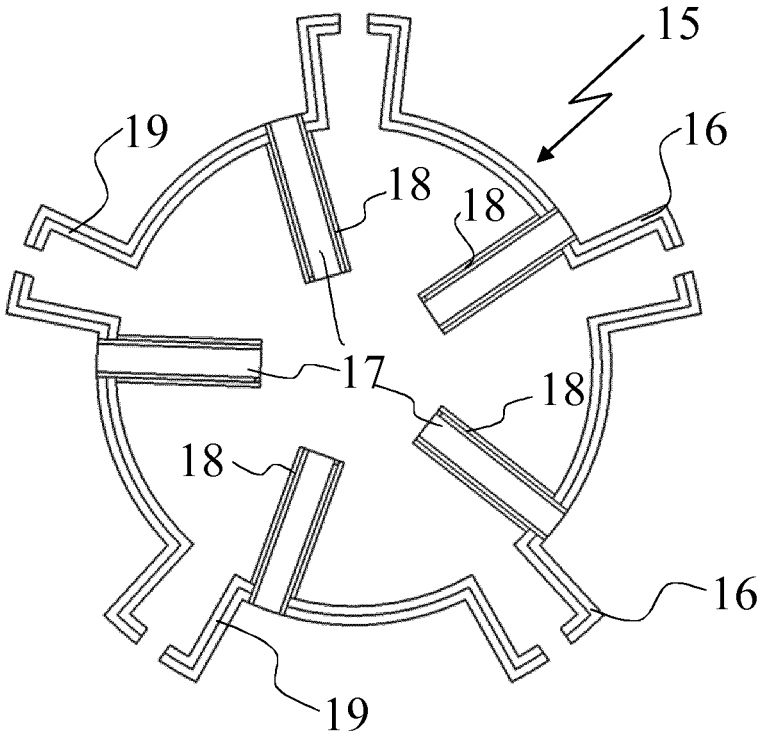

FIG. 5. Schematic top side-view (a) and bottom side view (b) of a dynamic sealing element for a variable valve timing system according to the present invention.

FIGS. 1 (*a*) and (*b*) show a schematic front side view respectively a schematic 3-dimensional view of a main body (1) of a rotor body for a variable valve timing system according to the present invention. The main body (1) comprises a central cavity (2) for receiving or comprising a central part comprising an bore hole; vanes (3), pockets (4) at the vane tips for receiving or comprising dynamic sealing elements (i) for engaging with the stator housing, grooves (5) at the front side and for receiving dynamic sealing elements (ii) for engaging with a front side cover, and channels for oil or air transport (6) at the surface at one side (6,*a*) and at the other side (6,*b*). The main body (1) also has grooves at the back side (not visible) for receiving dynamic sealing elements (ii) for engaging with a back side cover. The main body (1) is made of a fibrous reinforced polymeric material.

FIGS. 2 (*a*) and (*b*) show a schematic front side view respectively a schematic 3-dimensional view of a central part (10) comprising an axial bore (12) for a rotor body for a variable valve timing system according to the present invention. The central part (10) comprises a cylindrically shaped body (11) with a cylindrical outer surface and protrusions (13) on the outer surface. The protrusions can protrude into the main body (1) made of the fibrous reinforced polymeric material. The central part (10) comprising the axial bore (12) is made of metal.

FIG. 3 shows a schematic 3-dimensional view of the main body (1) and assembled therein the central part (10), representation an embodiment of a rotor body for a variable valve timing system according to the present invention.

FIG. 4 shows a schematic 3-dimensional view of a main body (1) and dynamic sealing element (15) of a rotor body for a variable valve timing system according to the present invention. The dynamic sealing element can be engaged with one side of the main body. Not shown in the figure is that the rotor body will have a similar second dynamic sealing element for engagement with the other side of the main body. The main body (1) has channels (6) at the top and at the bottom, and vanes (3) with grooves (5). The dynamic sealing element (15) has parts (16) to be engaged with the vanes, the parts (16) have lips (19) to be received by the grooves (5). The dynamic sealing element (15) also has parts (17) to be engaged with the channels (6), the parts (17) have lips (18) to be received by the channels (6).

FIG. 5 shows a schematic top side view (a) and bottom side view (b) of a dynamic sealing element for a variable valve timing system according to the present invention. The dynamic sealing element (15) has parts (16) to be engaged with the vanes and parts (17) to be engaged with the channels (6) in the main body. The dynamic sealing elements has lips (18) to be received by the channels (6) and lips (19) to be received by grooves (5) in the main body (1).

The invention claimed is:

1. A rotor body for a variable valve timing system for an engine, comprising a main body comprising a front side for engaging with a front side cover and a back side for engaging with a back side cover, vanes for defining variable oil or air pressure chambers inside a stator housing, having vane tips for engaging with the stator housing, channels for oil or air transport from one pressure chamber to other pressure chambers, and a central part comprising an (axial) bore hole running from the front side to the back side for receiving a camshaft or a bolt for fixing to the camshaft, wherein the main body is comprised of a fibrous reinforced polymeric material and the central part comprising the axial bore hole is made of metal, the rotor body comprises dynamic sealing elements (i) at the vane tips for engaging with the stator housing, and dynamic sealing elements (ii) at the front side and the back side for engaging with the front side cover and the back side cover wherein the dynamic sealing elements (i) and (ii) are made of a non-reinforced plastic material, and wherein the metallic central part comprises protrusions protruding into the fibrous reinforced polymeric material and/or holes filled with a fibrous reinforced material.

2. The rotor body according to claim 1, wherein the central part is made from machined metal, cast metal or sintered metal.

3. The rotor body according to claim 1, wherein the central metal part comprises a cylindrically shaped body with a cylindrical outer surface and protrusions on an outer surface protruding into the main body made of the fibrous reinforced polymeric material.

4. The rotor body according to claim 1, wherein the central part is installed into the rotor body via press fit, or by compression moulding or injection moulding of the polymeric material around the central part.

5. The rotor body according to claim 1, wherein the main body is comprised of an injection mouldable fibrous reinforced thermoplastic or thermosetting polymeric material.

6. The rotor body according to claim 1, wherein the sealing elements (i) and (ii) are made from an engineering polymer, PTFE or PTFE modified polymer.

7. The rotor body according to claim 1, wherein the sealing elements (i) are comprised by pockets at the vane tips.

8. The rotor body according to claim 1, wherein the sealing elements (ii) are comprised by grooves into the front and the back side, respectively.

9. The rotor body according to claim 1, wherein the channels for the oil or air transport are constituted by channels in the main body located at the surface at the front side and the back side of the main body, wherein the channels are covered with dynamic sealing elements (iii).

10. The rotor body according to claim 1, wherein a. the central metal part comprises a cylindrically shaped body with a cylindrical outer surface and protrusions on an outer surface protruding into the main body made of the fibrous reinforced polymeric material; and b. the channels for the oil or air transport are constituted by channels in the main body located at the surface at the front side and the back side of the main body, wherein the channels are covered with dynamic sealing elements (iii).

11. Variable valve timing system comprising an assembly of a rotor and a stator receiving the rotor on a camshaft, wherein the rotor is a rotor body according to claim 1, comprising a main body comprising a front side, a back side and vanes tips, made from a fibrous reinforced polymeric material, a central part comprising an (axial) bore hole made of metal, and sealing elements made of a non-reinforced polymeric material at the vain tips and at the front side and back side, wherein an end part of the camshaft and/or a fixing element is received in the axial bore hole and the rotor is fixed at the end part of the camshaft with the fixing element.

* * * * *